US005511597A

United States Patent [19]

Shantie et al.

[11] Patent Number: 5,511,597

[45] Date of Patent: Apr. 30, 1996

[54] SLABBING CHIPPER WITH REPLACEABLE KNIVES AND WEAR PLATE

[75] Inventors: Michael A. Shantie, Molalla; William C. Toogood, Beaverton, both of Oreg.

[73] Assignee: Key Knife, Inc., Portland, Oreg.

[21] Appl. No.: 369,666

[22] Filed: Jan. 6, 1995

[51] Int. Cl.[6] ..... B27G 13/04

[52] U.S. Cl. ..... 144/220; 144/218; 144/241; 407/46; 407/101

[58] Field of Search ..... 144/218, 230, 144/220, 241, 229; 241/91, 92, 189.1, 292.1, 278, 298; 407/37, 40, 41, 45, 46, 101, 87, 95, 104

[56] References Cited

U.S. PATENT DOCUMENTS 3,570,567 3/1971 Hickman ..... 144/220
3,875,984 4/1975 Plough ..... 144/220
4,984,614 1/1991 Landers et al. ..... 144/220
5,271,442 12/1993 Carpenter et al. ..... 144/218 X
5,333,659 8/1994 Carpenter et al. ..... 144/241

*Primary Examiner*—W. Donald Bray
*Attorney, Agent, or Firm*—Kolisch, Hartwell, Dickinson, McCormack & Heuser

[57] ABSTRACT

A log-slabbing chipper having a chipper head that includes a power-driven rotor head and multiple double-edged knives distributed about the rotor head. A detachable wear plate for each knife extends in covering relation over a cutting edge in the knife that occupies an inoperative position. The wear plate establishes a proper depth of cut for the cutting edge of a knife that follows the wear plate.

11 Claims, 5 Drawing Sheets

SLABBING CHIPPER WITH REPLACEABLE KNIVES AND WEAR PLATE

BACKGROUND AND SUMMARY OF THE INVENTION

This invention relates to wood-working machines, and more particularly to what is referred to herein as a slabbing chipper.

A chipper constructed pursuant to the present invention may include a power-rotated head which is disposed to one side of a support for an elongate work piece, such as a log. The head supports knife structures on its periphery which operate to chip off wood material on a log with relative longitudinal movement of a log across the end of the head. In a chipper as just described, the knife structures on the head move in sweeps across the side of the log to produce the chipping action.

Log slabbing chippers are known wherein each knife structure on the power-rotated head comprises a pair of double-edged knives. Each knife has one edge disposed in an operative, cutting position, and an opposite edge disposed in an inoperative position. With wear occurring in a knife, the knife can be turned to change the edge in the knife which is in an operative position. In the chipper being described, the operative cutting edge of one knife with rotation of the head moves in what might be thought of as a conical path, with cutting off of chips as the head is rotated. The operative cutting edge in the other knife moves generally in a plane, and functions to smooth or plane a flat surface on the log as the chips are cut away. A log slabbing chipper with multiple knife structures where each includes a pair of double-edged knives, as above described, is more fully disclosed in prior issued U.S. Pat. No. 5,271,442.

Difficulties have been encountered in a log slabbing chipper which includes knives with operative edges moving as just described, in the handling of logs of small diameter. Speaking in very general terms, with small logs, the aggressive cutting action of the knives in the chipper tends to result in the throwing forward of a log being processed in the chipper, so that travel movement of the log is irregular and not controlled, and an irregular cutting action producing the chips results. In addition to producing problems in controlling log movement, localized wear regions in the chipper have resulted, together with a rough cutting action in the chipper.

A general object of the invention is to provide a slabbing chipper with novel structure controlling the depth of cut produced by knives in the chipper, making for a more uniform cutting action and more controlled movement of a log through the chipper.

Another object is to provide a slabbing chipper, with double-edged knives producing the cutting action, which includes detachable and replaceable wear plates associated with the knives functioning to establish a uniform depth of cut in the knives. The wear plates are easily removed and replaced when maintenance so requires.

In a preferred embodiment of the invention, the chipper includes a power-rotated head, with multiple knife structures distributed about the head. Each knife structure in the chipper includes a double-edged knife, disposed with an operative cutting edge moving in a substantially conical path in producing chips. A detachable clamp holds this knife in place with the clamp extending in covering relation over the nonoperative cutting edge in the knife. The clamp is surfaced by an outer wear surface, which during operation of the chipper, slides against the surface just cut by the cutting edge in the knife associated with the wear surface, to establish a preselected depth of cut with respect to a corresponding following knife in the chipper.

In a specific and preferred embodiment of the invention, the chipper may be provided with one or more detachable limiting plates, with wear surfaces on these plates moving in substantially a plane, with this plane paralleling but offset from a plane established by planing edges in the chipper.

BRIEF DESCRIPTION OF THE DRAWINGS

These and other objects and advantages are attained by the invention, which is described herein below in conjunction with the accompanying drawings, wherein.

DETAILED DESCRIPTION OF THE PREFERRED EMBODIMENT

Figure 1:
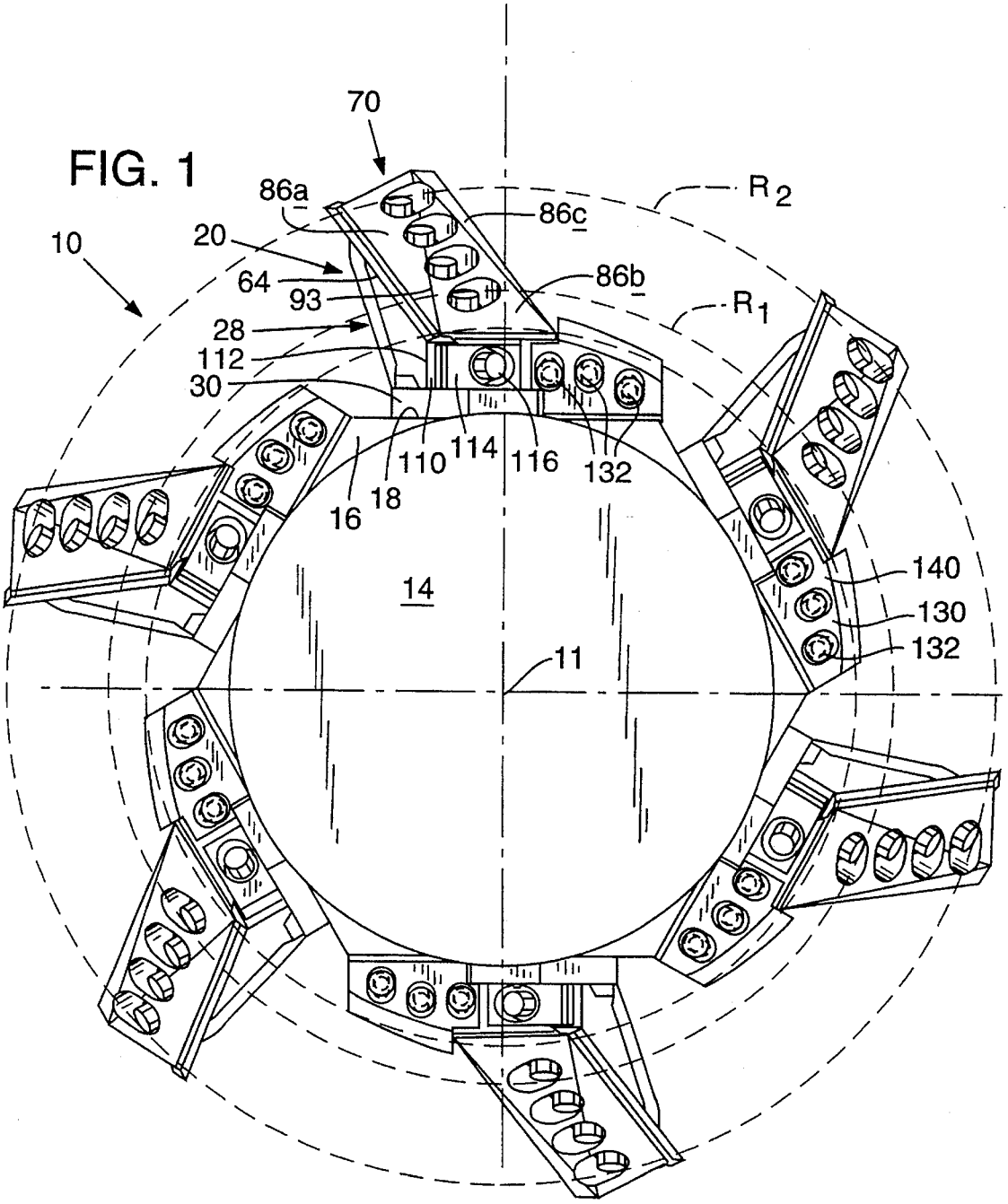
FIG. 1 is an end view of a chipper cutting head in a slabbing chipper, as contemplated by the invention.
Figure 2:
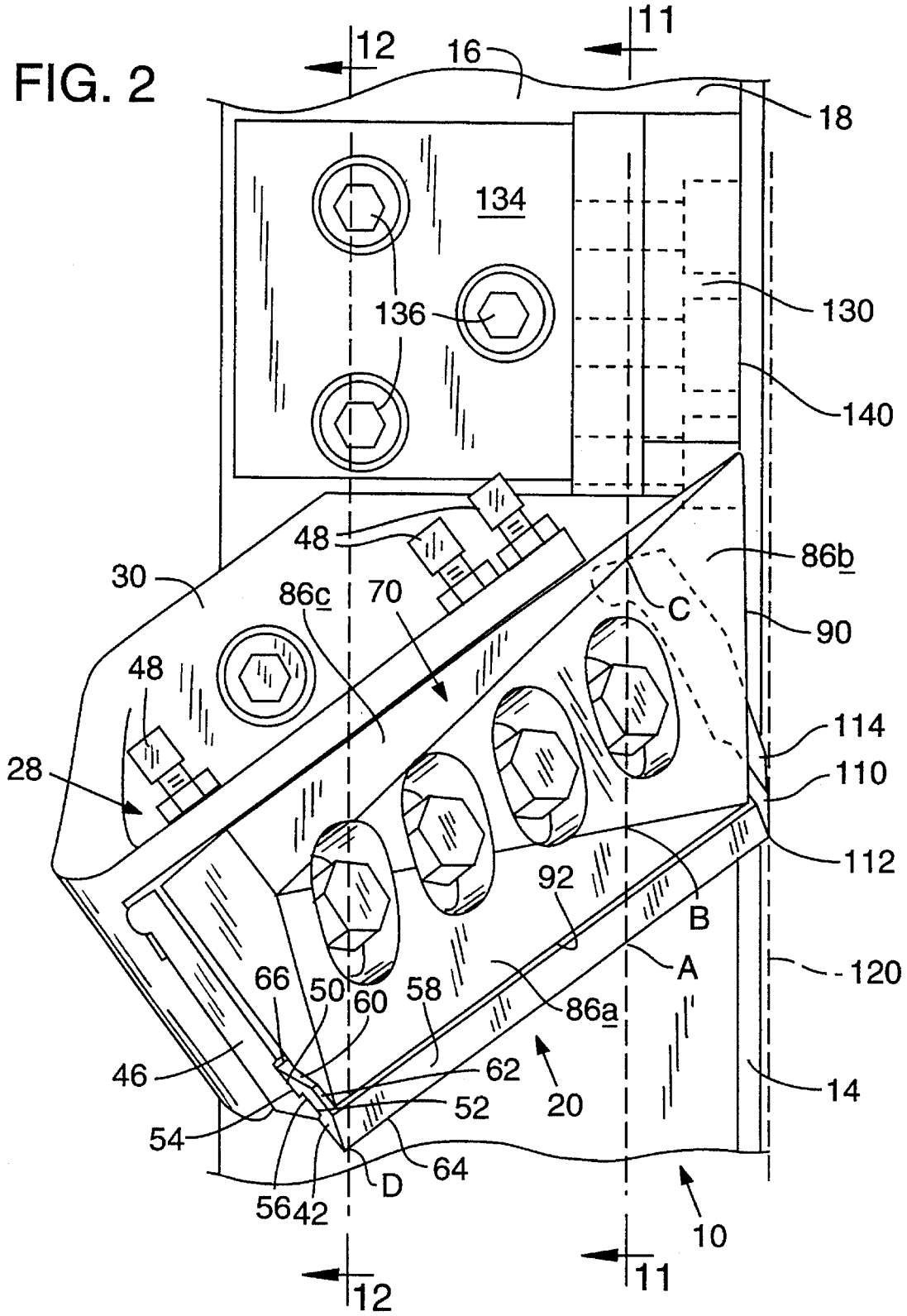
FIG. 2 is a view, somewhat enlarged, looking at a portion of the side of the chipper cutting head illustrated in FIG. 1.

Referring now to the drawings, and more particularly to FIGS. 1 and 2, illustrated in these figures is an end view and a partial side view, respectively, of a cutter head 10 of a log slabbing chipper. The chipper (or edger, as such is sometimes referred to) is a wood-working machine, and in addition to the cutter head includes a carriage or log supporting means (not shown) which mounts a log or other work piece, with the log and carriage being movable across the end of the cutter head, in a direction extending longitudinally of the log, and transversely of the rotation axis 11 of the cutter head 10. The cutter head together, with the usual motor for rotating it under power, is mounted ordinarily on a stand, with the stand being movable horizontally along a path which parallels the rotation axis of the cutter head. This movement shifts the cutter head toward or away from the axis of the log being processed.

The cutter head is rotated under power, about its rotation axis 11. With a log advanced across the front of the cutter head, and to the extent that the cutter head overlaps an edge margin of the log, such margin is cut away by the cutter head and chips are produced therefrom.

At the front of the cutter head and part of the cutter head is a face plate 14. The face plate is fixedly secured to the front of a power-rotated rotor head 16 (also part of the cutter head) rotatable about axis 11. Referring particularly to FIG.

1, the rotor head, in the embodiment of the invention herein being discussed, includes six platform regions 18 distributed about its perimeter. Secured in place on each platform region is what is referred to herein as a knife structure 20.

Figure 3:
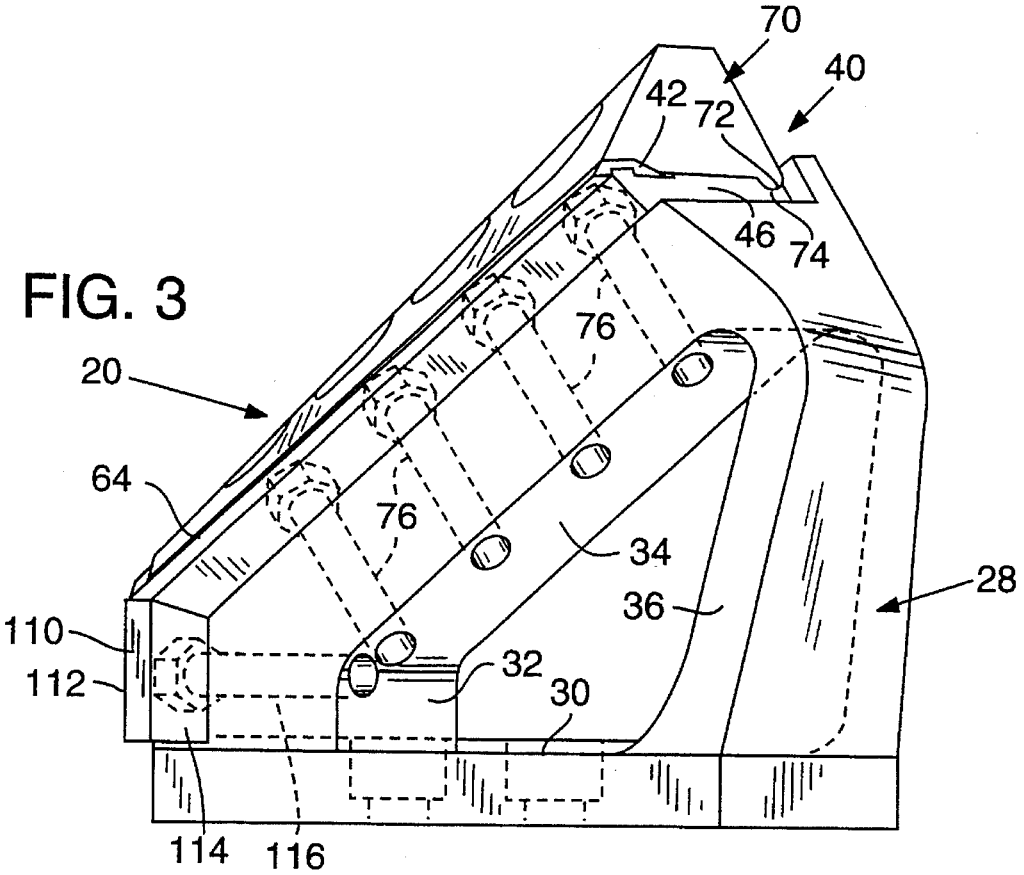
FIG. 3 is a side view of a knife structure in the log slabbing chipper.

Considering in more detail the construction of a knife structure (referring also to FIG. 3), as the term is used herein, each includes what is referred to herein as a holder 28. Holder 28 has a base 30 secured by suitable fasteners to a platform region 18. Also part of the holder is an upstanding portion 32, a backing portion 34 joined to and extending out at an angle from the upstanding portion, and a bracing portion 36.

Figure 11:
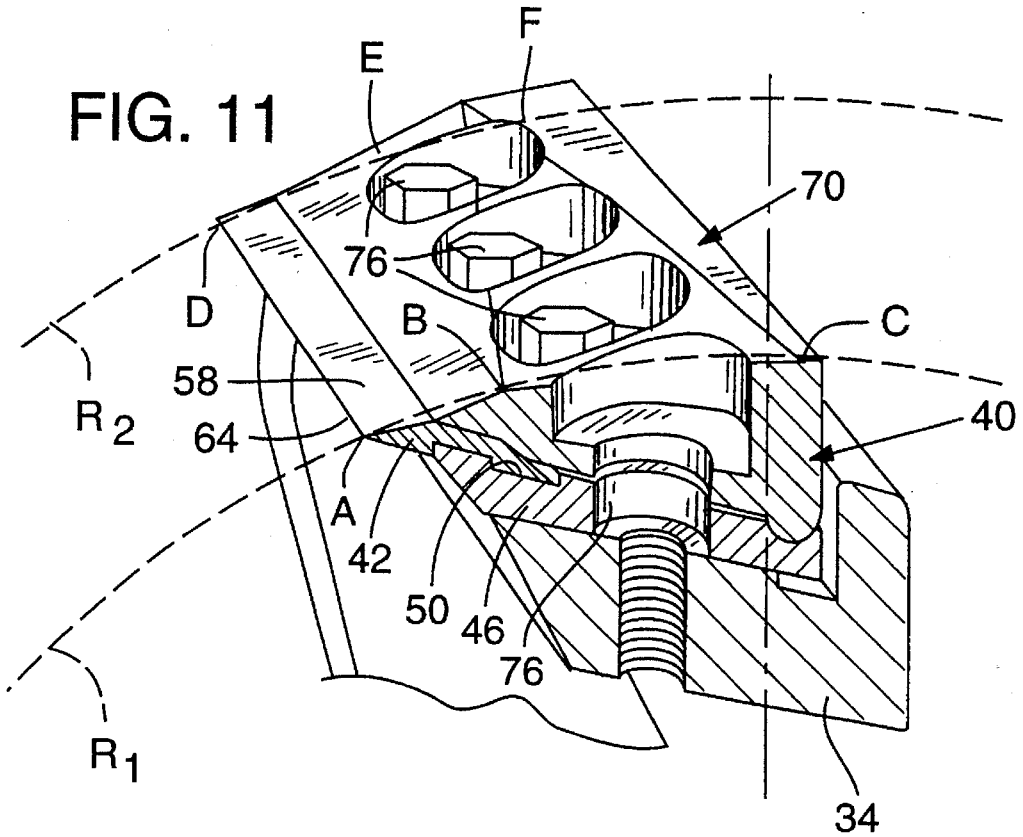
FIGS. 11 and 12 are partial, cross sectional views, of a knife structure, in planes normal to the axis of rotation of the cutting head, and taken along the lines 11—11 and 12—12, respectively, in FIG. 2.
Figure 12:
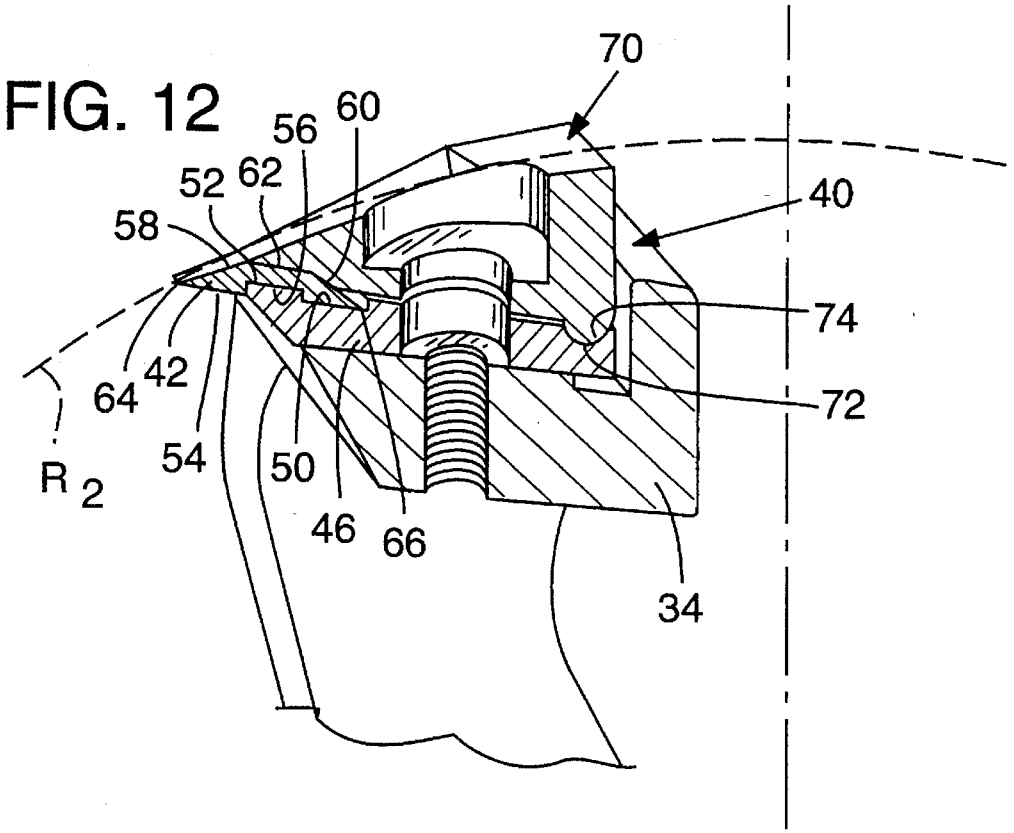

Referring now also to FIGS. 11 and 12, backing portion 34 provides support for a knife mounting assembly 40 mounting an elongate double-edged knife 42. The knife mounting assembly includes an elongate knife support or support element 46 which rests against backing portion 34 of the holder. Determining an established position of the knife support on the holder are abutment screws 48 (see FIG. 2) mounted on the backing portion which abut a rear edge of support element 46. The knife support adjacent its forward edge is provided a shallow channel 50, and a shallow ridge 52 is defined between channel 50 and the forward extremity of support element 46.

Knife 42 has a bottom face, and indented upwardly from the bottom face is a shallow groove 56. Opposite bottom face 54 are back knife surfaces 58, 60 and clamping surface 62. Edges 64, 66 extend along opposite extremities of the knife. The knife is symmetrical about a plane bisecting the bottom face and groove 56.

The knife sits on the knife support with ridge 52 of the support located within groove 56. This accurately positions the knife on the knife support or support element. As so positioned, one of the edges of the knife is exposed and occupies an operative cutting position, as exemplified by edge 64, this edge being located in advance of the knife support element. The opposite edge of the knife, as exemplified by edge 66, occupies an inoperative or not-in-use position.

Holding the knife firmly against the support element 46 is an elongate detachable wear plate 70. The wear plate also functions in the particular construction illustrated as a clamp that clamps against clamping surface 62 of the knife. The wear plate has a rock shoulder 72 which fits within a groove 74 presented on support element 46.

Securing the wear plate, the knife support element and the knife altogether and against the backing portion 34 of the holder, are a series of screws or fasteners 76. These are threadably received within suitable threaded bores provided in the holder backing portion.

The other knife structures in the cutter head are constructed in the same manner as the knife structure specifically herein described. Each has an elongate double-edged knife corresponding to knife 42. All these knives extend in an inclined fashion so that their forward ends (which are the ends facing the viewer in FIG. 1) are closer to the axis of the cutter head than the rear ends of the knives. The knives are also positioned so as to be inclined or skewed with respect to a plane containing the axis of the cutter head and passing through the end of a knife. This skewed position of the knife means that when the cutter head is rotated to produce cutting (which would be in a counter clockwise direction in FIG. 1), the outer extremities of a knife and its operative cutting edge leads the knife as cutting is performed with a slicing action resulting as the chips are cut.

The operative or in use cutting edges of the various knives move in a common conical path with rotation of the cutter head. These edges moving in this conical path are the ones that perform the principal chip-cutting action when the cutter head is rotated against a log with the log moved thereacross.

It will be noted that each wear plate in a knife structure, and now referring also to FIGS. 5–10, has an outer wear surface which, in the particular embodiment illustrated, is made up of three planar surface portions, namely, surface portion **86*a*, surface portion 86*b*, and surface portion 86*c*. Surface portion 86*a* extends from the front edge 92 of the wear plate at an angle which approximates the angle of back knife surface 58 with respect to the front face of the knife. Surface portion 86*b* slopes outwardly from inner edge 90 of the wear plate and intersects surface portion 86*a* along the line 93. As seen in FIG. 1, line 93 lies approximately in a plane which passes through the axis of the cutter head. Surface portion 86*b* diverges from the bottom of the wear plate progressing outwardly, so that the wear plate in effect has increasing thickness progressing from its inner end to its opposite outer end in a region which extends along the length of the wear plate. Rear surface portion 86*c* intersects surface portion 86*b* at line 94**.

With the configuration described and with the wear plate clamping onto a knife element and seated against support element 46, a wear surface is provided with an outer extremity in a region where the wear surface intersects a plane extending from the axis of the rotor that moves in a conical path which substantially parallels and is only slightly inwardly from the path of the operative cutting edge of the knife held by the wear plate (as well as the corresponding knives in the other knife structure). The wear surface of the wear plate at points distributed throughout the length of the wear plate contacts the surface just cut by the cutting edge of the knife which the wear plate holds in place to prevent the log or work piece from advancing at too fast a rate to interfere with operation of the chipper head and the production of properly cut chips. A depth of cut is established by the wear surface by establishing a uniform spacing between the just cut surface of the work piece a slight distance inwardly from the path of the cutting edge in the knife that follows.

Describing a typical installation, with the construction just described, and a wear plate configured as described, the region of the plate where surface portions **86*a*, 86*b* intersect are along line 92** with operation of the cutter head might move in a conical path which is parallel to but only perhaps less than one-quarter inch inwardly from the path of the cutting edge of the knife. This spacing would be uniform throughout the length of the wear plate.

With the configuration described, and with the wear plate clamping against a knife and the assembly properly seated against knife support 46, at discrete points or locations of the operative cutting edge of a knife clamped by the wear plate, points on the wear surface in direct trailing relation rotate in arcs only slightly inwardly from the arcs within which the knife points move. Further explaining, and referring to FIG. 2, with rotation of the cutter head, point A on the knife rotates in a circular arc which is shown at R1 in FIG. 11. In the wear plate, points at B and C rotate in arcs which are only slightly inwardly of arc R1. At point D of the knife, which is farther out on the knife, the knife location moves in an arc illustrated at R2 in FIGS. 11 and 12. Points indicated at E and F rotate in arcuate sweeps only slightly radially inwardly from the arc R2. This relationship is established for multiple points throughout the length of the cutting edge of the knife. Further explaining, the wear surface of the wear plate at points distributed throughout the length of the wear plate contacts the surface just cut by the cutting edge of the knife to prevent the log or work piece from advancing too fast and at a rate to interfere with the operation of the cutter head. A depth of cut is established by the wear surface, by establishing a uniform spacing between the just cut surface of the work piece from the path of the cutting edge in the knife that follows. It should be remembered that with operation of the slabbing chipper, a log is being forced forwardly as the cutting head is rotated, so that as each knife cuts into the wood, a cut surface is formed which is somewhat inwardly from the conical path of the cutting edge in the following knife, and by controlling advance of the log, this depth of cut distance tends to be uniform.

Describing a typical installation with the construction just described, typically points distributed along the length of the wear plate will move in paths which are at the most no more than about a quarter inch radially inwardly from the paths of points of the knife cutting edge which are directly in advance of the wear plate points.

In the cutting head described, each knife structure further includes what is referred to as a planing knife 110 which is also a double-edged knife of similar cross section to knife 42. The knife is mounted with its operative cutting edge 112 exposed. Mounting the knife is a clamp 114, which clamps the knife against a support constructed similarly to support 46. Securing the assembly together is a fastener 116.

Each of the knife structures includes a planing knife similar to the one specifically described. The exposed cutting edges of all these knives, with rotation of the cutter head, move in a common path, which is in a plane normal to the axis of rotation of the cutter head. This plane is indicated in FIG. 2 at 120.

An inner edge 90 has been described in connection with a wear plate. With the wear plate mounted in place, this edge, as can be seen in FIG. 2, extends in a direction which substantially parallels cutting plane 120 of the planing knives, but occupies a position laterally offset from this plane. The edge, therefore, is referred to as a fending edge, as it tends to fend off material and prevent over aggressive cutting of the cutting edges in the various planing knives 110.

Figure 4:
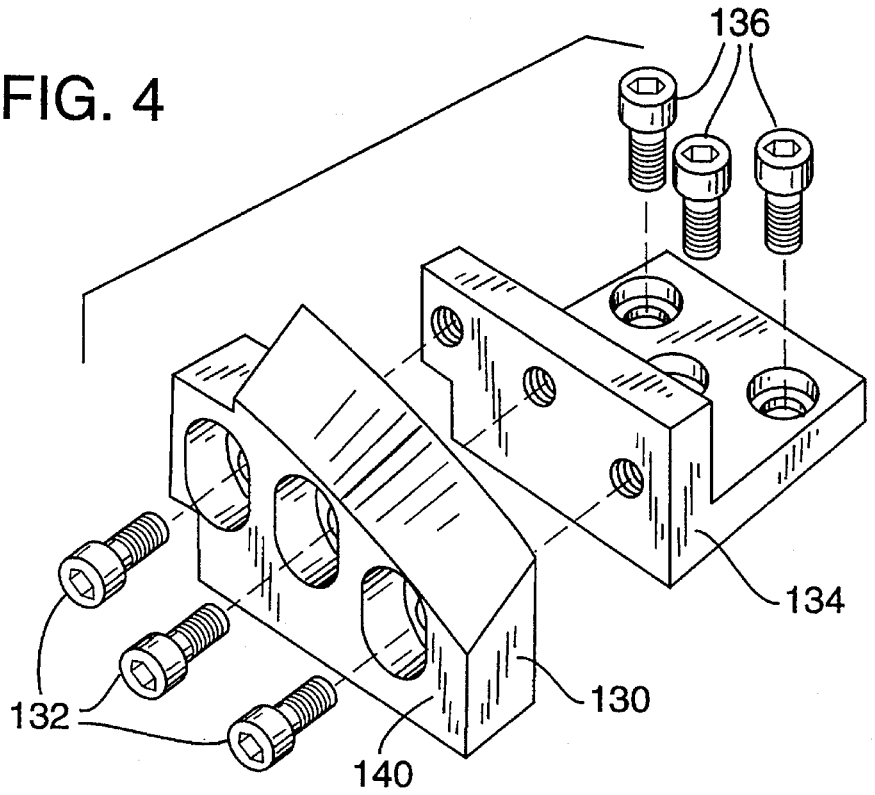
FIG. 4 is an exploded view, illustrating a limiting plate that may be included in the cutting head, and illustrating parts used in mounting the limiting plate.
Figure 5:
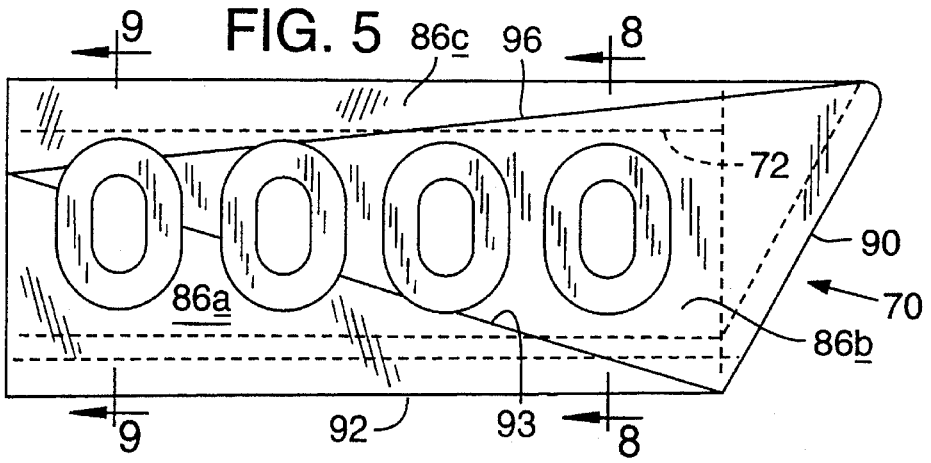
FIG. 5 is a top plan view of a detachable wear plate in a knife structure.
Figure 6:
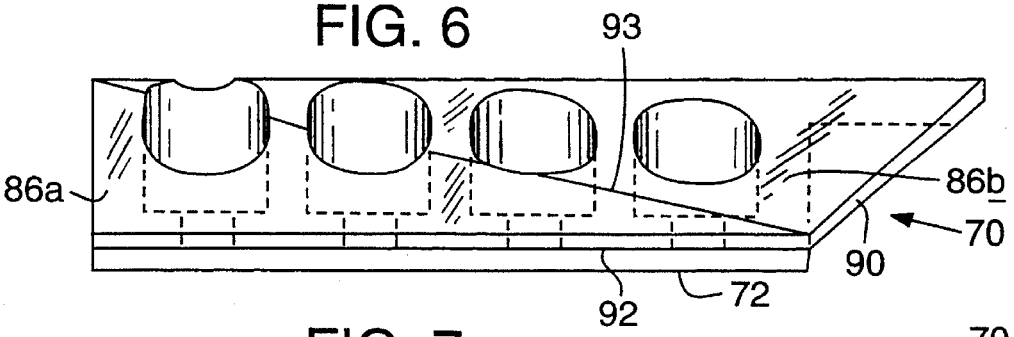
FIGS. 6 and 7 are side views showing opposite sides of the wear plate shown in FIG. 5.
Figure 7:
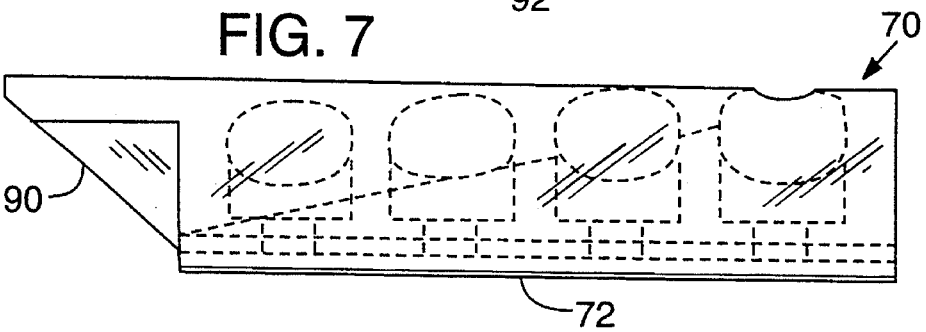
Figure 8:
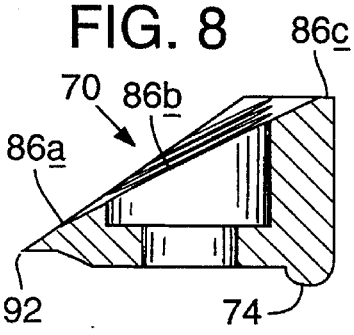
FIGS. 8 and 9 are cross sectional views, taken generally along the line 8—8 and 9—9, respectively, in FIG. 5.
Figure 9:
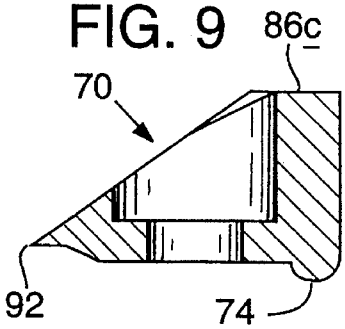
Figure 10:
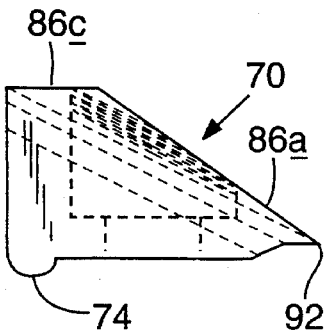
FIG. 10 is an end view of the wear plate in FIG. 5.

Each knife structure may further be provided with a limiting plate, such as the one shown at 130. The limiting plate is secured by fasteners 132 to an angle bracket 134 (see FIG. 4), and this angle bracket in turn is secured by fasteners 136 to a platform region 18. Face 140 of the limiting plate constitutes a wear face. This face ordinarily rotates with rotation of the cutter head in substantially the plane defined by rotating fending edge 90. Thus, together with the fending edge, the detachable limiting plate associated with each knife structure limits aggressive cutting by the planing edges.

The construction described is particularly advantageously employed in connection with the handling of smaller logs where difficulties have been encountered in controlling the regular feed of a log to produce proper chip cutting.

It should be noted that all of the elements provided for limiting the cutting action of the cutting edges are readily replaced when necessary should excessive wear occur in their respective wear surfaces.

While a particular embodiment of the invention has been described, it should be obvious that modifications and variations are possible without departing from the invention.

It is claimed and desired to secure by Letters Patent:

1. In a slabbing chipper for cutting work advanced into the chipper and reducing such to chips:

a power-driven rotatable rotor head, rotatable about an axis, a pair of knives each having a cutting edge, support for the knives supporting the knives on the rotor head and supporting one knife with the cutting edge of said one knife on rotation of the cutter head moving in a plane normal to the axis of the rotor head and supporting the other knife with the cutting edge of said other knife on rotation of the cutter head moving in a path of substantially conical configuration, and a clamp for said other knife clamping the knife against said support and the clamp having one end and an opposite end, said clamp having an elongate region extending along its length of increasing thickness progressing from said one end to said opposite end of the clamp and said region having an outer wear surface that contacts the work being cut by the chipper.

2. The slabbing chipper of claim 1, wherein said one end of the clamp is bounded by an edge which extends in a direction substantially paralleling said plane.

3. The chipper of claim 1, which further includes a detachable limiting plate secured to said rotor head having a wear surface substantially paralleling said plane but offset therefrom.

4. In a slabbing chipper:

a power-driven rotor head rotatable about an axis, a pair of knives, each knife having a first cutting edge and a second cutting edge and the first and second cutting edges paralleling each other, support for the knives supporting one of said knives on the rotor head for movement with the rotor head with said one knife positioned with its first cutting edge in an operative position and movable in a plane normal to the axis of the rotor head, and supporting the other knife on the rotor head with said other knife positioned with its first cutting edge in an operative position and moveable in a path of substantially conical configuration, and an elongate clamp for said other knife clamping the knife against said support and the clamp having one end and an opposite end, said clamp having an elongate region extending along its length of increasing thickness progressing from said one end to said opposite end of the clamp, said region being surfaced by an outer wear surface, said one knife being turnable on said support to place the second cutting edge thereof in said operative position and said second knife being turnable on said support to place said second cutting edge thereof in said operative position, said clamp covering the second cutting edge of said other knife and said wear surface extending in trailing relation to said second cutting edge.

5. In a slabbing chipper:

a power-driven rotor head rotatable about a rotation axis, a pair of knives, each having a cutting edge, a support for the knives supporting one of the knives on the rotor head for movement with rotation of the rotor head with the cutting edge of the one knife moving in a plane and said plane extending substantially normal to said rotation axis, and supporting the other knife on the rotor head for movement with rotation of the cutter head with the cutting edge of the other knife moving in a path of substantially conical configuration, and a clamp for said other knife clamping the knife against said support, said clamp having opposite ends and an elongate fending edge extending along one of said ends substantially paralleling said plane but offset therefrom.

6. The chipper of claim 5, wherein said clamp has increasing thickness extending in the direction of the length of the clamp from said one to the opposite end of the clamp.

7. The chipper of claim 6, which further includes a detachable limiting plate secured to said rotor head with a wear surface substantially paralleling said plane but offset therefrom together with said fending edge.

8. In a slabbing chipper:

a power-driven rotatable rotor head which is rotatable about an axis, multiple knives mounted on said rotor head, each knife having one cutting edge occupying an operative position and another cutting edge occupying an inoperative position, and said one cutting edge of the multiple knives moving in a common path which is of conical configuration, each knife having a following knife on the rotor head, a detachable wear plate associated with each knife, having a depth of cut establishing wear surface which contacts the cut surface of a work piece cut by the one cutting edge of the associated knife at locations distributed along the length of the wear surface, and which establishes a substantially uniform spacing of the cut surface of the work piece with respect to the one cutting edge of a following knife on the rotor head.

9. The chipper of the claim 8, wherein the detachable wear plate associated with each knife extends in covering relation over the cutting edge of the knife that occupies an inoperative position.

10. The slabbing chipper of claim 9, wherein the detachable wear plate associated with a knife includes a clamp surface which clamps against and holds in place the knife associated with the wear plate.

11. The slabbing chipper of claim 10, wherein the detachable wear plate has an elongate fending edge forming an end of the wear plate which moves in a plane with rotation of the rotor head and serves to limit movement of work relative to the rotor head in a direction extending along the axis of the rotor head.

* * * * *